US007540121B2

(12) United States Patent
Haeussler

(10) Patent No.: US 7,540,121 B2
(45) Date of Patent: Jun. 2, 2009

(54) STEEL-CONCRETE HOLLOW BODIED SLAB OR CEILING

(75) Inventor: Wilhelm Haeussler, Füssen (DE)

(73) Assignee: BAM AG, St. Gallen (CH)

( * ) Notice: Subject to any disclaimer, the term of this patent is extended or adjusted under 35 U.S.C. 154(b) by 0 days.

(21) Appl. No.: 11/659,745

(22) PCT Filed: Aug. 12, 2005

(86) PCT No.: PCT/EP2005/008819

§ 371 (c)(1),
(2), (4) Date: Feb. 8, 2007

(87) PCT Pub. No.: WO2006/018253

PCT Pub. Date: Feb. 23, 2006

(65) Prior Publication Data

US 2007/0271864 A1 Nov. 29, 2007

(30) Foreign Application Priority Data

Aug. 13, 2004 (DE) ..... 20 2004 012 814 U
Mar. 19, 2005 (DE) ..... 20 2005 004 622 U

(51) Int. Cl.
*E04C 2/30* (2006.01)

(52) U.S. Cl. ..... 52/323; 52/577; 52/649.1

(58) Field of Classification Search ..... 52/576, 52/577, 432, 414, 649.1, 309.7, 320, 323, 52/337, 341, 686, 745.05; 404/17, 34; 249/175
See application file for complete search history.

(56) References Cited

U.S. PATENT DOCUMENTS 1,119,435 A * 12/1914 Kuhne ..... 52/577
1,160,384 A * 11/1915 Crane ..... 52/577
2,272,363 A * 2/1942 Callaway, Jr. ..... 52/688
2,969,619 A * 1/1961 Didrick ..... 52/601
3,857,217 A * 12/1974 Reps ..... 52/592.1
3,864,888 A * 2/1975 Tupper et al. ..... 52/745.05
4,495,744 A * 1/1985 Carl ..... 52/576
4,702,048 A * 10/1987 Millman ..... 404/34
5,797,230 A * 8/1998 Lassen ..... 52/323
6,205,737 B1 * 3/2001 Haussler ..... 52/649.1

(Continued)

FOREIGN PATENT DOCUMENTS

AU 434110 B * 3/1973

*Primary Examiner*—Richard E Chilcot, Jr.
*Assistant Examiner*—Bryan Eppes
(74) *Attorney, Agent, or Firm*—Notaro & Michalos P.C.

(57) ABSTRACT

The invention relates to a steel-concrete hollow bodied slab or ceiling comprising concrete webs, which are arranged in between hollow bodies, and a reinforcing layer on top of the hollow bodies and a reinforcing layer underneath the hollow bodies, wherein a hollow body is embodied as a peripherally closed container which is devoid of any ascending force and which is open towards the bottom, whereby ventilation holes are provided in the covering wall thereof and the container comprises spacers. The aim of the invention is to obtain a low-cost hollow bodied slab/ceiling exhibiting good load-bearing behavior and an increased ability to discharge transversal forces according to local requirements. According to the invention, the concrete in at least one concrete web consists of high-tensile fibers and/or at least one steel strut, preferably a double wall anchor, and/or the hollow body which is devoid of ascendant forces has a conical or truncated pyramidal periphery whose uppermost end forms a dome-shaped arch.

1 Claim, 10 Drawing Sheets

Figure 1A:
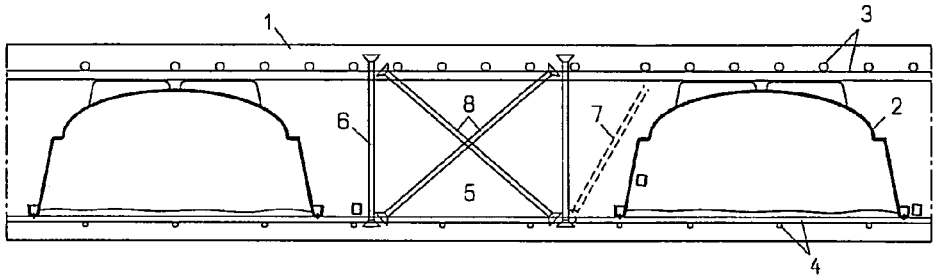

U.S. PATENT DOCUMENTS 6,550,207 B1 * 4/2003 Pontarolo ..... 52/577
2003/0110724 A1 * 6/2003 Haussler ..... 52/414
2005/0284071 A1 * 12/2005 Houben ..... 52/576
2007/0214740 A1 * 9/2007 O'Grady ..... 52/577

* cited by examiner b a

STEEL-CONCRETE HOLLOW BODIED SLAB OR CEILING

The present invention relates to a steel-concrete hollow bodied slab or ceiling with concrete webs disposed between the hollow bodies and with a reinforced layer above the hollow bodies as well as with a reinforced layer beneath the hollow bodies. It relates furthermore to an uplift compression-free hollow body for the production of such steel-concrete hollow bodied slabs or ceilings, which is implemented as an uplift compression-free, downwardly open and circumferentially closed container, in whose ceiling wall venting holes are optionally provided, the container including spacers. It relates furthermore to a steel-concrete hollow bodied slab or ceiling, which comprises said hollow bodies.

A steel-concrete hollow bodied slab is disclosed in EP 1 252 403 A1. For its production are used hollow bodies such as are described for example in DE 200 04 140 U1.

Each reinforced layer is comprised of two superjacent layers of parallel reinforcement rods, the rods of the one reinforced layer preferably being rotated in their course by an angle of 90 degrees with respect to those of the other layer. In connection with the compression-resistant concrete, these reinforcements are intended to generate a flexurally strong slab/ceiling, which can absorb the locally occurring bending moment. In addition to the bending moments, a slab/ceiling is also subject to internal, vertically shearing forces, i.e. transverse forces. Due to the low concrete tensile strength which can be assessed computationally, and the cross sectional diminishment through the hollow bodies, the capability of a hollow bodied slab/ceiling not reinforced in the concrete webs to carry transverse forces is severely limited. To increase the transverse force load-bearing strength, the concrete webs between the hollow bodies were therefore previously reinforced, as a rule, time- and material-intensively, for example with the aid of cages, with perpendicularly installed shear allowance between the lower and upper bending reinforcement layer or with closed clips which encompass the [core] irons of the bending reinforcement and therefore hinder especially strongly the construction process and raise the cost of the ceiling. Reinforcement cages are described in DE 298 21 000 U1. In EP 1 252 403 A1, alternatively to the above listed shear reinforcement types, vertical reinforcements in the concrete web nodes are specified. By concrete web node are understood points in the ground plan in which the axes of adjacent concrete webs meet.

To reduce the weight of steel-concrete slabs and steel-concrete ceilings, structural elements are known which have hollow bodies in the meshwork. In DE 298 21 000 U1 reference is made to uplift compression-free containers forming hollow volumes, which for precise positioning can be suspended on the lower reinforcement layer in reinforcement cages. These reinforcement cages are comprised of an upper ring formed of a round steel bar and a corresponding lower ring, which, by means of upright struts are coaxially secured at a spacing from one another. To decrease the material consumption, in particular for the additional saving of steel and concrete, the technology of hollow volume-forming containers was further developed. DE 100 04 640 A1 discloses an uplift compression-free hollow body of conical form with annular spacers, which omits the coaxial strutting of the reinforcement cage as described in DE 298 21 000 U1. The annular spacers have openings, which serve for receiving reinforcement rods for their fixing. However, the fabrication of the hollow bodies with the separately cut annular spacers is elaborate such that container production in mass fabrication is not possible.

The invention addresses the problem of specifying a cost-effective hollow bodied slab/ceiling with favorable carrying behavior and with increased transverse force load-bearing strength according to local requirements.

The problem is solved in a slab according to the genus thereby that the concrete of at least one web comprises tension-resistant fibers and/or at least one steel strut preferably one double tie bolt. In addition to the known instrument of vertical reinforcement in the concrete web nodes, the invention therewith provides further instruments which can be combined with this vertical reinforcement, or with one another, in order to adapt the transverse force load-bearing strength to the local loading.

The problem is also solved thereby that it comprises a vertical reinforcement in or near a concrete web node, which is formed by hook-mono tie bolts (12).

Said instruments for the adaptation of the transverse force load-bearing strength to the local loading are:

1. Addition of tension-reisstant fibers, for example steel fibers to the green concrete.
   To save unnecessary costs, the zones beneath and above the hollow bodies and concrete webs, which are in any event reinforced with reinforcement rods, are preferably not provided with fibers. This is technically possible since the zone under the hollow bodies and concrete webs, the zone of the concrete webs and the zone above the hollow bodies and concrete webs can be concreted sequentially in three phases, but still "green in green".
2. Installation of a compression-resistant structural element, preferably double tie bolt, approximately in the axis of the occurring compression diagonal in some concrete webs.
   By transverse force stress of the slab/ceiling as [latticed] framework bearing system developed, which, inter alia, has inclined compression struts. Such an inclined compression strut starts at the intersection of the horizontal reinforced layer above the hollow bodies with the plumb line in the concrete web node, and ends at the intersection of the horizontal reinforced layer beneath the hollow bodies with the plumb line in an adjacent convrete web node. This compression strut thus extends diagonally in the concrete web from above to below. If vertical reinforcements are located between the concrete web nodes, the inclined compression struts form between the vertical reinforcements.
   The compression strut can form due to the compression resistance of the concrete.
   Through the installation according to the invention of an additional compression-resistant structural element, preferably double tie bolts, approximately in the axis of the compression diagonal, the load-bearing capability of this compression diagonal is considerably increased beyond the load-bearing capability of a pure concrete strut.
   It is here statically favorable that the compressed additional structurel element cannot bend out laterally due to the concrete which envelops it completely, and thus may be thin.
3. Installation of a structural element of tensile strength, preferably a double tie bolt, approximately in the axis of the occuring tension diagonal in some concrete webs.
   Under the transverse force stress of the slab/ceiling a framework bearing system develops, which inter alia comprises inclined tension struts.
   Such an inclined tension strut preferably starts at the intersection of the horizontal reinforced layer beneath the hollow bodies with the plumb line in the concrete web node and preferably ends at the intersection of the horizontal reinforced layer above the hollow bodies with the plumb line in an adjacent concrete web node. This tension strut thus extends diagonally in the concrete web from below to above, however, inclined counter to the compression strut stated under Number 2, crossing it in the center of the strut.

Due to the low tensile strength of the concrete which can barely be assessed computationally, the tension strut can only develop if approximately in the axis of the tension strut a tension-resistant structural element sufficiently anchored at the ends, is installed, preferably a double tie bolt or a hook-mono tie bolt.

4. Installation of vertical reinforcements, such as double tie bolts, hook-mono tie bolts, Z-clips or U-clips, which, differing from known shear reinforcements, are not located in the concrete web nodes, but rather in the concrete webs between two concrete web nodes, as well as installation in the concrete web nodes of vertical reinforcements such as hook-mono tie bolts, Z-clips or U-clips.

Accordingly, advantageous embodiments of the invention are described in the dependent claims.

Said reinforcement instruments can be combined with one another and with the vertical reinforcements in the concrete web nodes described in EP 1 252 403 A1, such that advantageously an increase of the transverse force load-bearing strength of the slab/ceiling to the extent locally required can be attained.

Beyond the EP 1 252 403 A1, 11 combination feasibilities result with the invention for increasing the transverse force load-bearing strength.

Figure 2A:
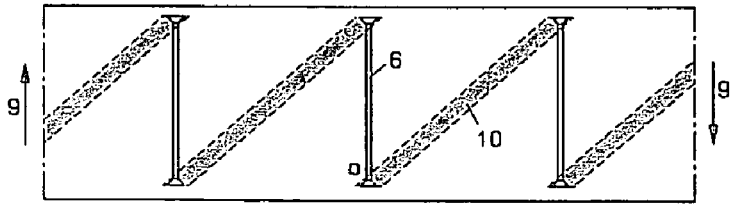
Figure 2B:
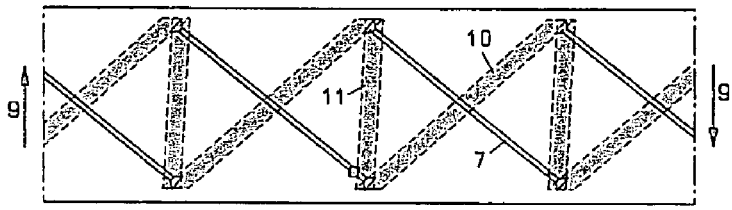
Figure 2C:
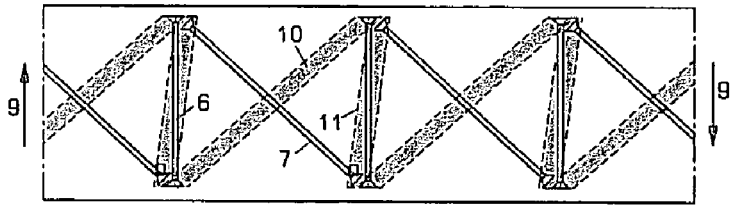
Figure 2D:
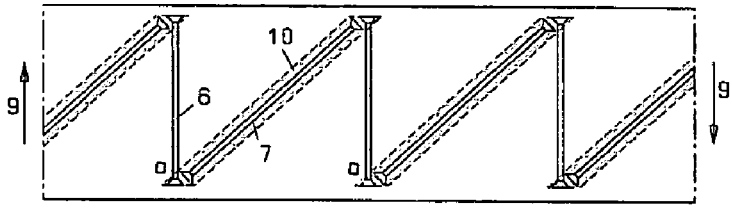
Figure 2E:
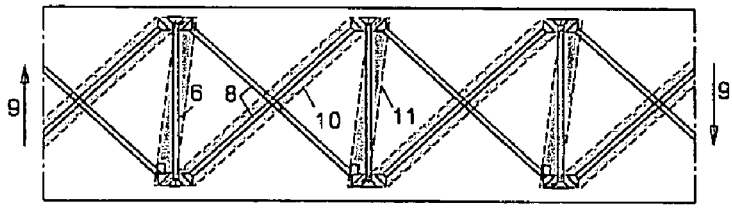

| Combination | Strut Development | Fibers |
|---|---|---|
| 1 | acc. to FIG. 2a | without fibers |
| 2 | acc. to FIG. 2a | with fibers |
| 3 | acc. to FIG. 2b | without fibers |
| 4 | acc. to FIG. 2b | with fibers |
| 5 | acc. to FIG. 2c | without fibers |
| 6 | acc. to FIG. 2c | with fibers |
| 7 | acc. to FIG. 2d | without fibers |
| 8 | acc. to FIG. 2d | with fibers |
| 9 | acc. to FIG. 2e | without fibers |
| 10 | acc. to FIG. 2e | with fibers |

In one embodiment of the invention as vertical reinforcement and/or as steel tension struts, instead of double tie bolts, hook-mono tie bolts are installed into concrete web nodes and/or into one concrete web. These are rods of round reinforcement steel bars with ribbed surface, which, for introducing tensile force into the tie bolts, have one head at the bottom, preferably formed as a flat cone, such as double tie bolts have in duplicate, and, at the top for the introduction of tensile force into the tie bolts, have a hook which, after installation, extends around a rod of the reinforced layer above the hollow bodies.

In a different embodiment of the invention, after laying the upper horizontal reinforced layer, as the vertical reinforcement into concrete web nodes and/or into the concrete webs between two concrete web nodes, instead of double tie bolts, are installed Z or U-shaped clips whose horizontal end shanks, of sufficient length for the anchorage of the tensile force in the clip, encompass each at least the inner layer of the upper and lower horizontal reinforced layer. This embodiment has the special advantage that it permits assessing the transverse force load-bearing strength of clip-reinforced steel-concrete structural parts, which capability is computationally high according to the steel-concrete standards DIN 1045-1 and EC 2. For this purpose it utilizes reinforcement irons which can advantageously be produced simply and cost-effectively of concrete steel. U- and in particular Z-clips have the advantage of being readily mountable after laying the upper horizontal reinforced layer.

The implementation of locating the vertical reinforcement in the concrete webs, instead of, or in addition to, the vertical reinforcement in the concrete web nodes, advantageously permits decreasing the horizontal distance of the vertical reinforcement rods, where necessary, and therewith to achieve an increased transverse force load-bearing strength.

By vertical reinforcement rod is to be understood according to the invention a single vertical reinforcement rod or a group of vertical reinforcement rods upright next to one another, which at the top and bottom are adequately anchored in concrete, for example also irons bent in the shape of a hat.

It is of special advantage that with the invention shear reinforcements in the form of co-called shear allowances between the upper and lower horizontal reinforced layer can be avoided. These are less capable of load bearing than clips or double tie bolts. Conventional shear allowances with tied-together or welded-together reinforcement rods are moreover elaborate in production and interfere with the installation of distancing fittings between the hollow bodies.

Of special advantage, on the other hand, is in an embodiment of the invention the use of commercially available, readily obtainable, produced fully automatedly and therefore cost-effective double tie bolts. Their geometry is moreover optimized for absorption, of tension and compression forces and for introducing these forces from the concrete into the bolt.

The embodiment of the invention, which uses hook-mono tie bolts, offers the special advantage that it is even more economic than embodiments with double tie bolts. For a hook-mono tie bolt is more cost-effective in the production and ensures rapid installation, since it only needs to be suspended via a rod of the reinforced layer over the hollow bodies and connected with it by means of reinforcement lacing wire against slipping during the concreting.

Of especial advantage is in another embodiment of the invention the use of fibers, for example steel fibers, which are added to the green concrete before the concreting.

Due to the steel fibers, tensile strength of the building material even after the occurrence of concrete cracks is attained and hereby also the ductility of the structural part under shearing stress is improved. As a result the assessable transverse force load-bearing strength is increased.

In combination with steel struts, preferably double tie bolts, increasing the transverse force load-bearing strength, the use of fiber concrete is advantageous, since it increases the cracking tensile strength of the building material and therewith the load-bearing strength of the compression diagonal in the internal framework generated under shear stress.

Steel fibers are advantageously obtainable commercially and quickly. Their production is advantageously fully automated, and thus cost-effectively, and the introduction into the concrete is also cost-effective. If the fibers, according to one embodiment of the invention, are only added to the concrete for the concrete webs, the quantity of the required fibers is cost-effectively reduced.

The problem the invention addresses is also solved thereby that the uplift compression-free hollow body has a periphery in the form of a truncated cone or a truncated pyramid, whose upper termination forms a cupola-like vaulting. Compared to the conical containers employed in practice, this geometric form has greater rigidity for absorbing the vertical loading, for example of worker loads, weight of the upper reinforcement and of the green concrete during mounting, reinforcing and concreting. During the introduction of concrete, it can be distributed faster due to the favorable flow form. Due to the cupola-like form of the hollow body, in addition, in the region above the hollow body in the cured concrete, a statically favorable vaulting bearing effect occurs if this region is under vertical loading.

An alternative solution of the problem provides that at the hollow bodies as the upper spacers at least three radially disposed ribs are provided, preferably offset by equal angles, which are formed onto the cupola-like vaulting. Since the uplift compression-free hollow bodies are preferably comprised of recyclable synthetic material, the radially disposed ribs can be fabricated together with the hollow body in one production step. Consequently the production costs as well as the mounting times on the building site are reduced. In addition, the otherwise customary fastening means, such as wire, etc. for the spacers, can be omitted. The spacers, moreover, permit employing an especially advantageous windable reinforcement. The mounting time, and therewith the costs, can be further reduced.

A further alternative solution of the problem proposes that the uplift compression-free hollow body comprises an annular offset in the region between the truncated cone- or truncated pyramid-shaped periphery toward the cupola-like vaulting. This makes possible stacking several hollow bodies one on top of the other if there is a requirement for greater ceiling height. The upper hollow body is in this case adapted in its lower opening diameter to the diameter of the annular offset of the lower hollow body. Depending on the static requirements, ceilings of different height can in this way be set up without greater mounting expenditures.

In the implementation of the invention it is of special advantage that the cupola-like vaulting of the hollow body in cross section has approximately the form of one half of an ellipse. With this structuring chosen the air volume of the hollow body increases considerably, such that this fact not only leads to a significant saving of concrete, but also to a further weight reduction of the entire steel-concrete ceiling, whereby greater span widths of the ceilings can be realized.

A further implementation of the invention provides with advantage that a foot ring forms the lower termination of the hollow body. The structural integrity of the hollow body during the mounting is thereby increased and also its rigidity.

The invention provides that distancing clips are disposed as lateral spacers to further hollow bodies uniformly distributed over the periphery of the hollow body. They serve for the simple and secure positioning and fixing of the setup hollow bodies on the lower reinforced layer.

According to the invention it is furthermore of advantage if the distancing clips are formed in the shape of a U and preferably have a snap securement. With a snap securement it is possible to omit the complicated wiring of the hollow bodies with one another and to shorten thereby additionally the mounting times additionally.

To increase the rigidity of the hollow body, it is furthermore provided that the spacers formed into the cupola-shaped vaulting continue radially to the perimeter as a bead.

Further advantageous embodiments are described in claims 20 and 22.

In implementing the inventions, it is of special advantage if several hollow bodies are stackable through their suitable shaping such they nest within one another during transport and storage and thus save volume. For this purpose the upper and the lower contour of the hollow bodies must be matched to one another.

In order for the stacked hollow bodies to be more readily detached from one another, horizontal faces are advantageous. For example lower edges of stacking webs are provided, in which stacked hollow bodies sit one above the other. For this purpose it is advantageously provided that stacking webs are disposed beneath the annular offset. The stacking webs improve in addition the capability of the hollow body to absorb vertical loads.

The problem the invention addresses is lastly solved especially advantageously through a steel-concrete hollow bodied slab or ceiling, which utilizes the inventive hollow body as well as also the inventive increase of the transverse force load-bearing strength through fiber concrete, and/or steel struts, preferably double tie bolts, and/or vertical reinforcements in at least one concrete web, since in this way all expenditure-lowering embodiments are implemented. Such a steel-concrete hollow bodied slab is advantageously further developed through the above described characteristics.

The invention will be described by example in a preferred embodiment with reference to a drawing, wherein further advantages and details can be found in the Figures of the drawing. Functionally equivalent parts are provided with identical reference symbols.

Figure 1B:
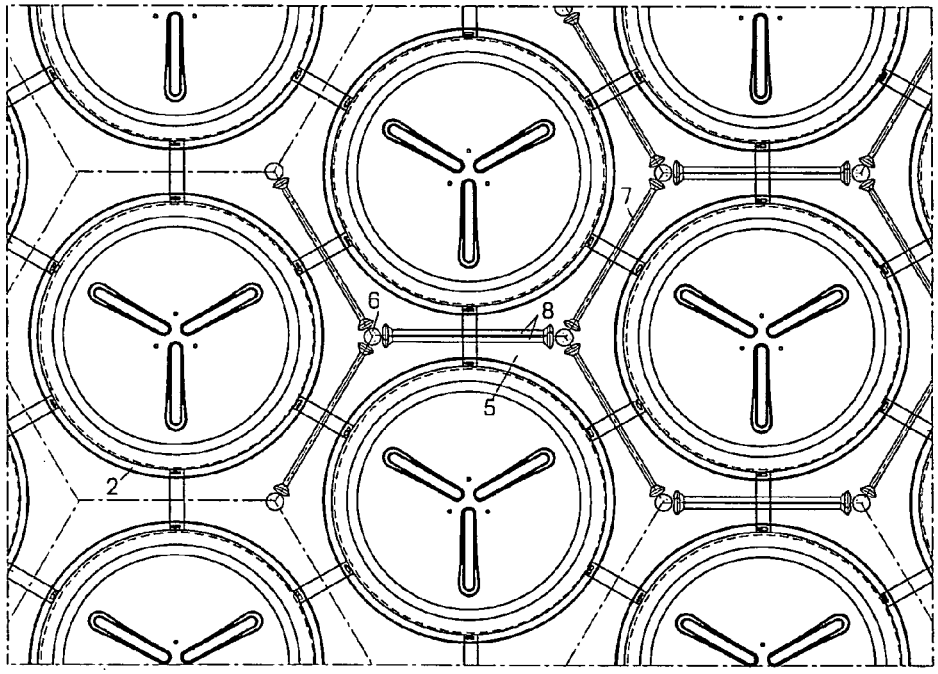
Figure 3A:
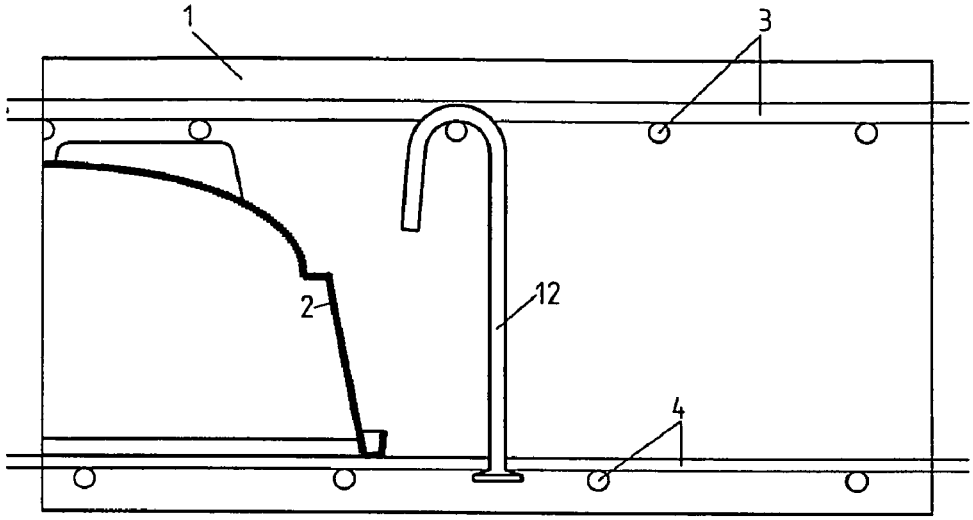
Figure 3B:
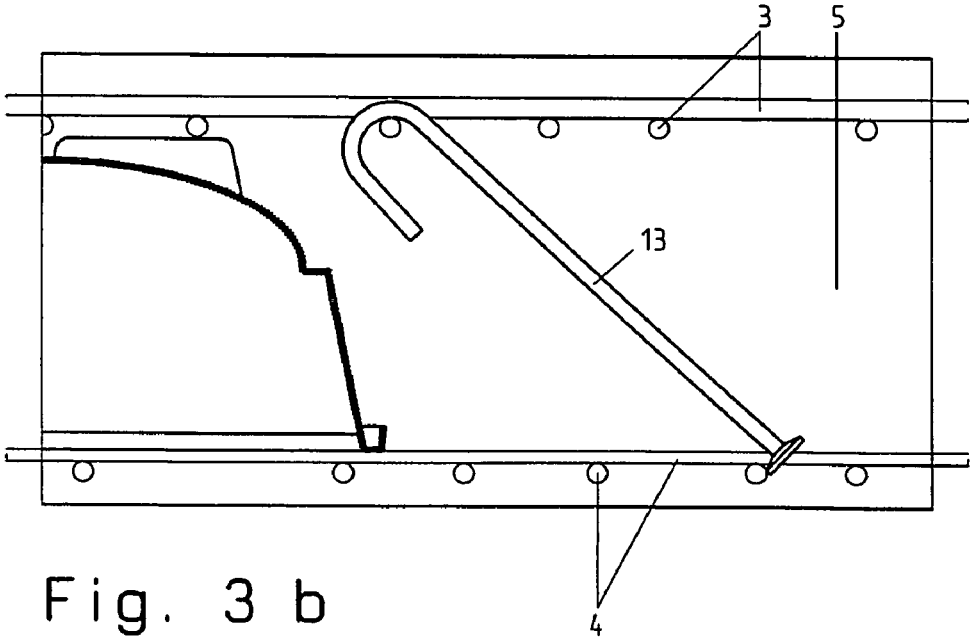
Figure 4:
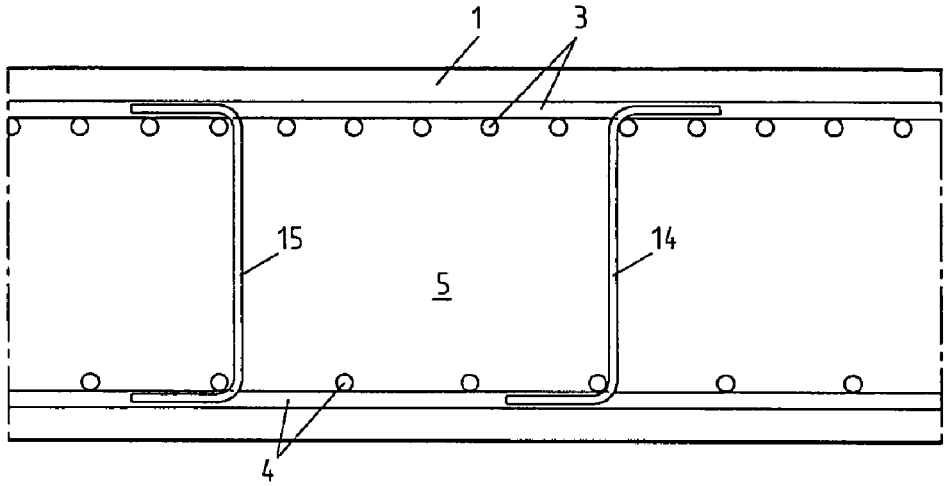
Figure 5:
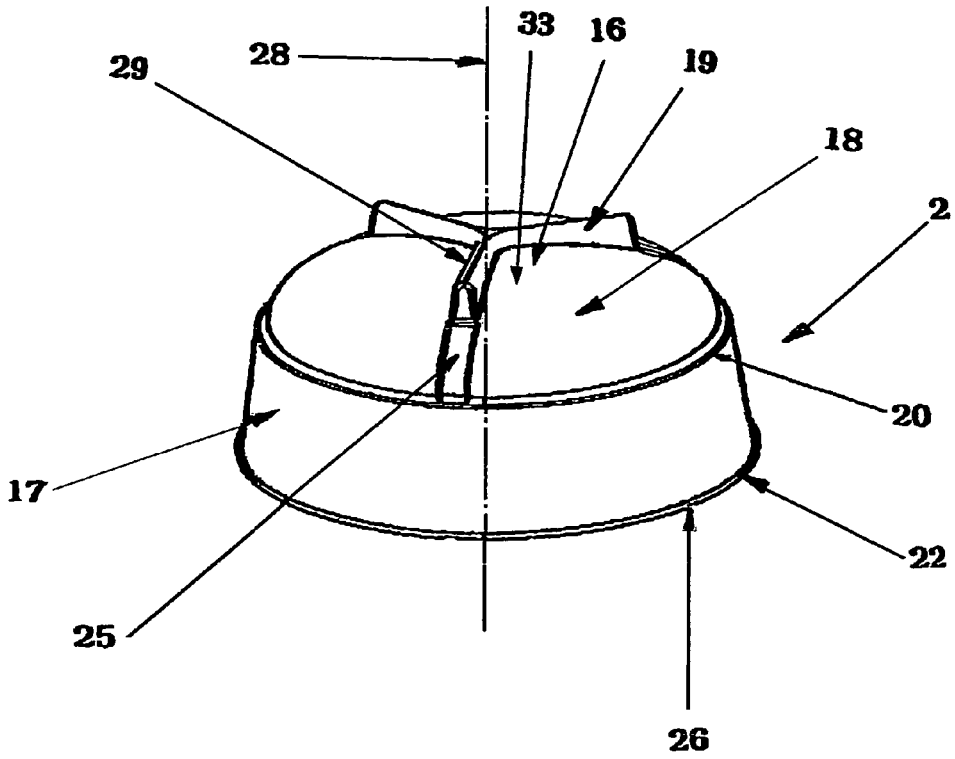
Figure 6:
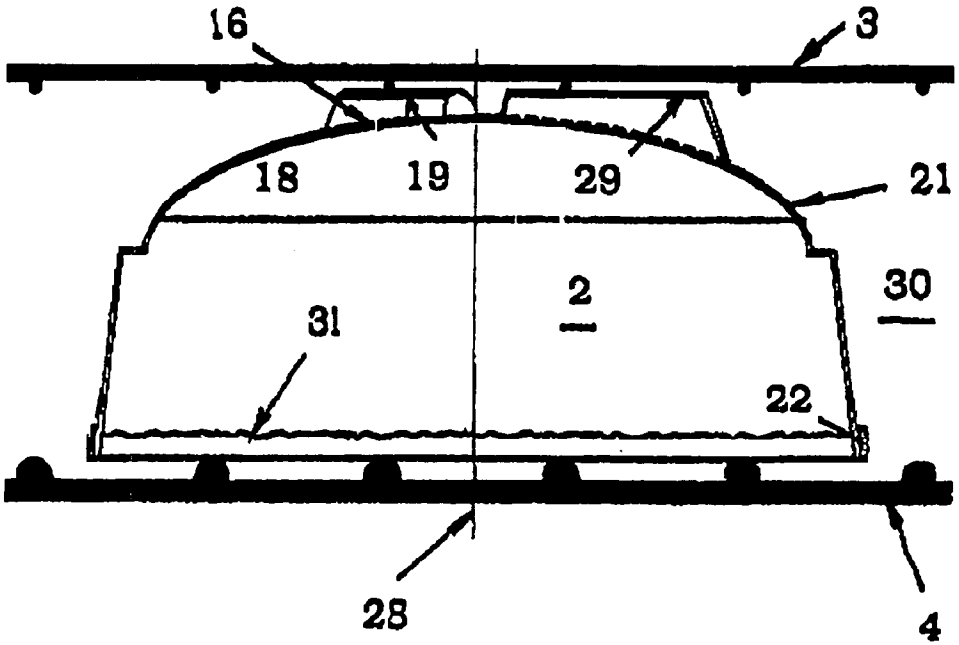
Figure 7:
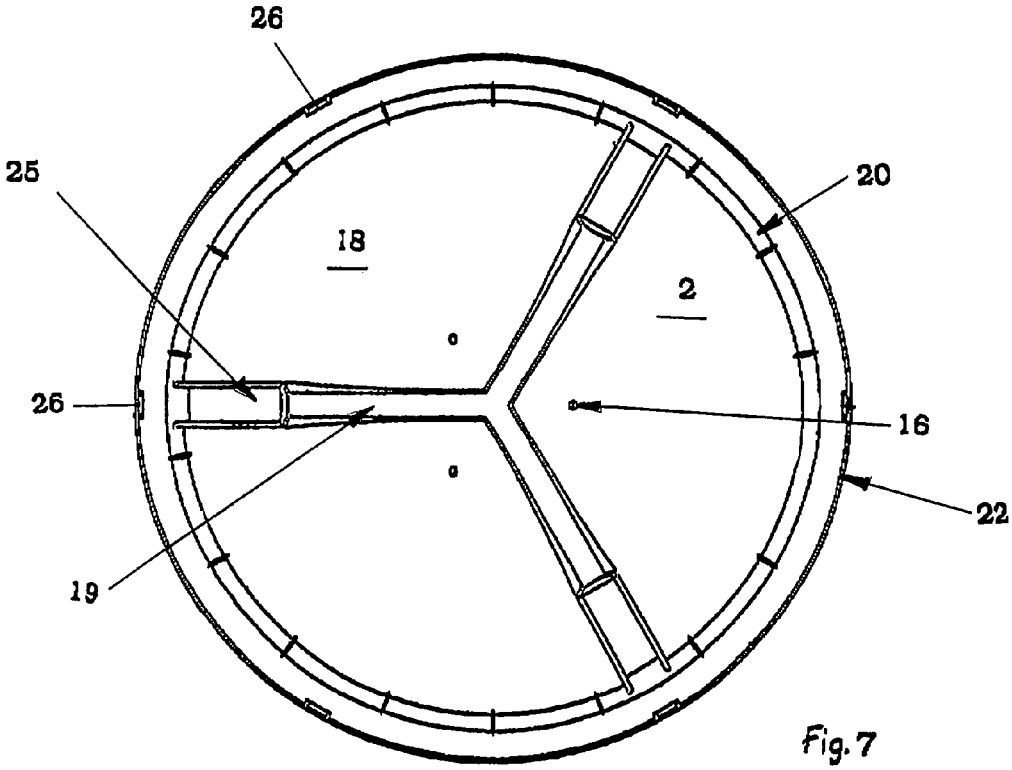
Figure 8:
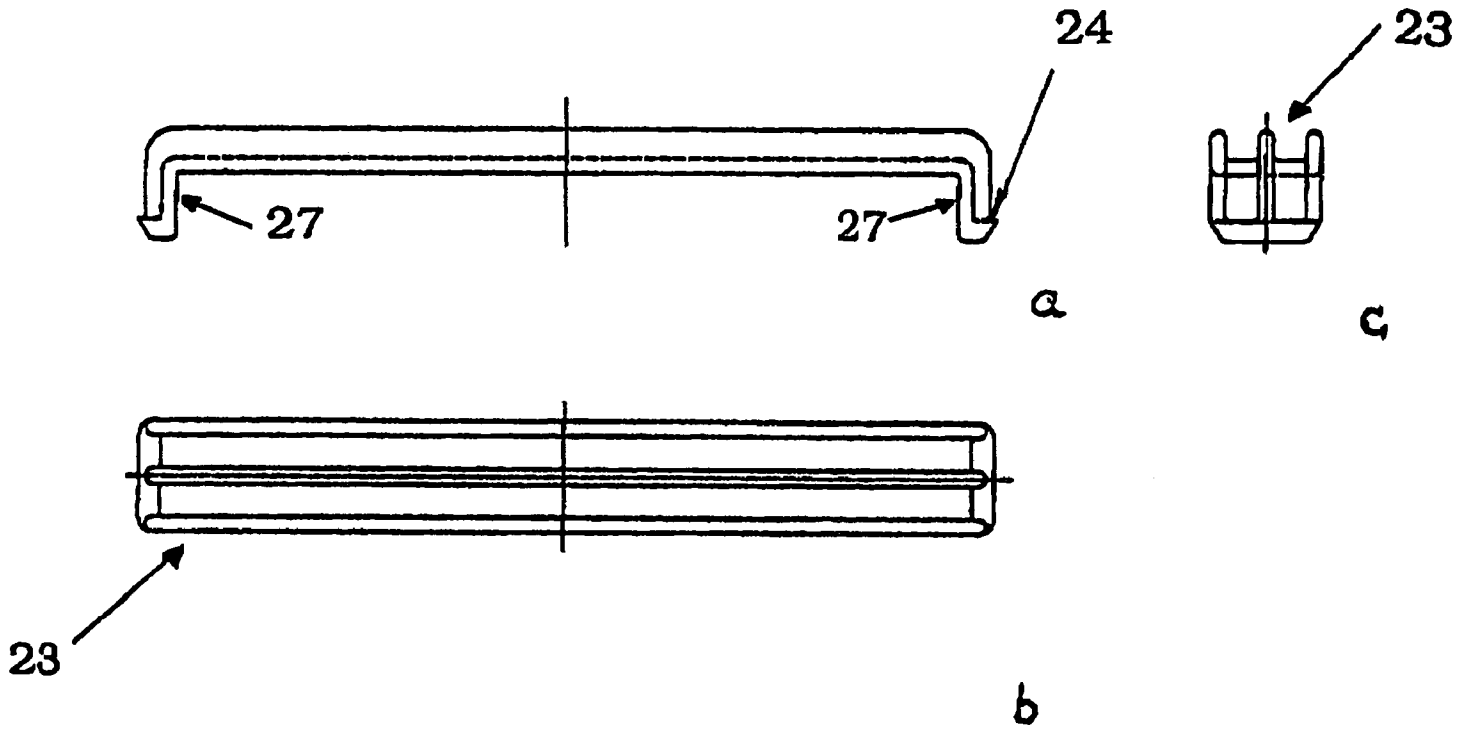
Figure 9:
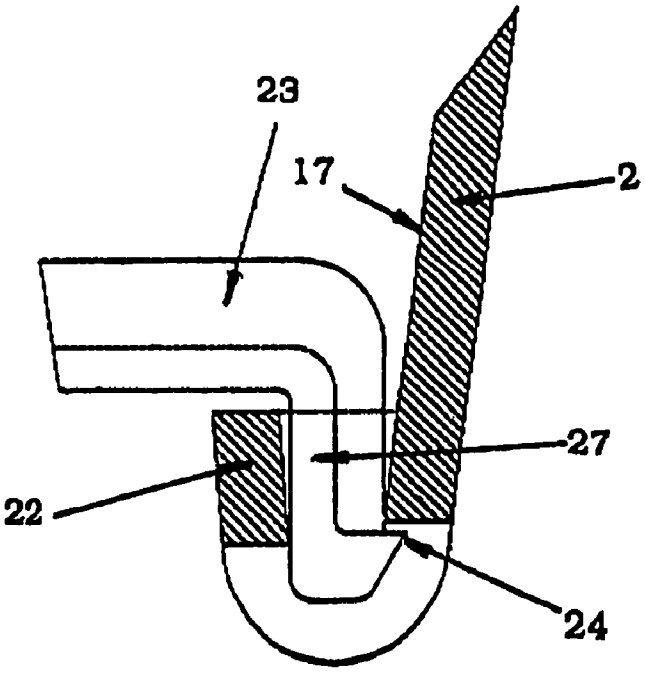
Figure 9:
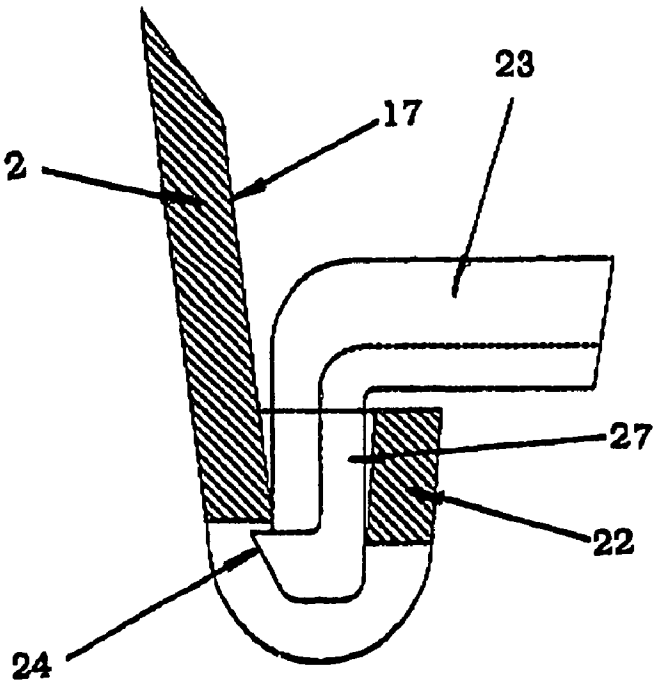
Figure 10:
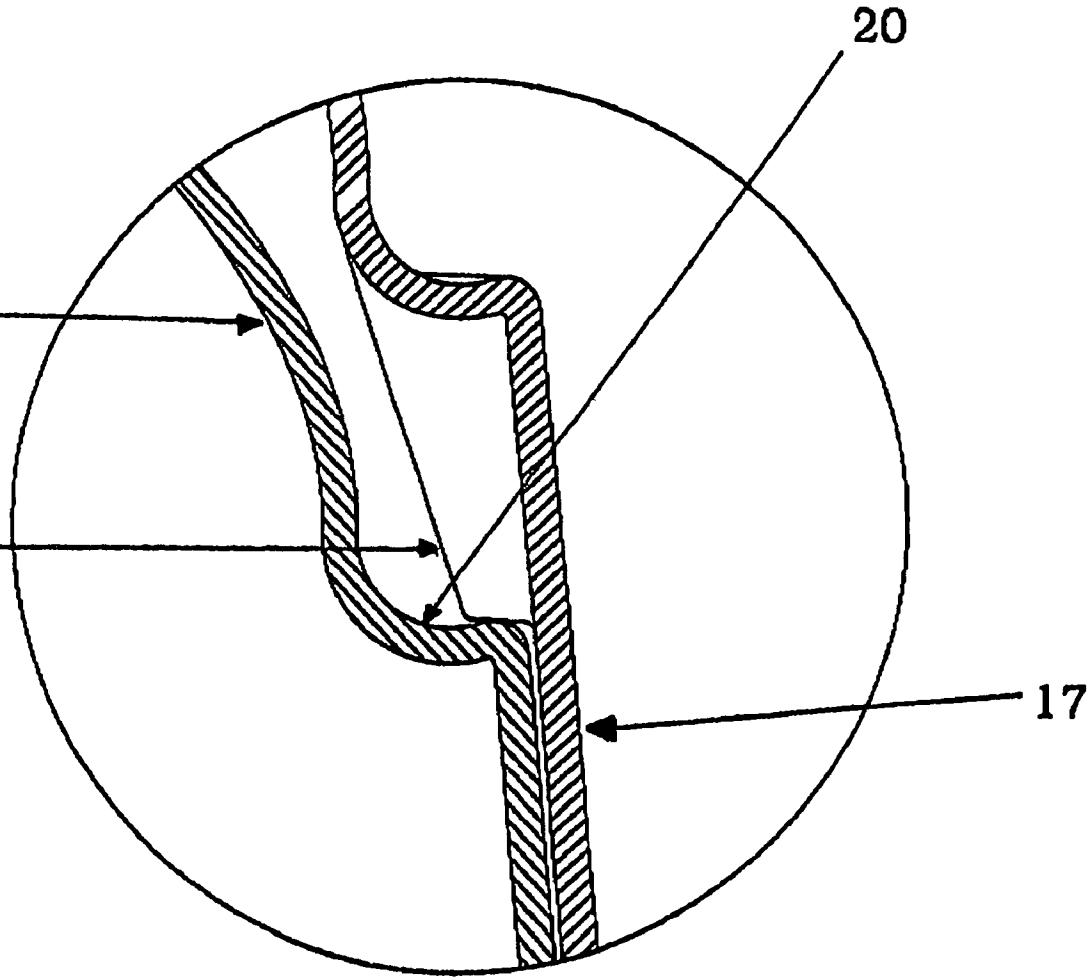

In the Figures depict:

FIG. 1*a:* a vertical section through a hollow bodied ceiling,

FIG. 1*b:* a top view onto a portion of a hollow bodied ceiling,

FIG. 2*a:* an embodiment with only vertical double tie bolts as the vertical reinforcement with the inner framework bearing formwork forming under transverse force loading, FIG. 2*b:* an embodiment with double tie bolts only in the inclined tension struts of the inner framework bearing formwork forming under transverse force loading, FIG. 2*c:* an embodiment with vertical double tie bolts as the vertical reinforcement and double tie bolts in the inclined tension struts of the inner framework bearing formwork forming under transverse force loading, FIG. 2*d:* an embodiment with vertical double tie bolts in the concrete web nodes and double tie bolts in the inclined compression struts of the framework bearing formwork forming under transverse force loading and FIG. 2*e:* an embodiment with vertical double tie bolts in the concrete web nodes and double tie bolts in the inclined compression struts and oppositely inclined tension struts of the inner framework bearing formwork forming under transverse force loading, FIG. 3*a:* an embodiment with hook-mono tie bolt at the vertical reinforcement, FIG. 3*b:* an embodiment with hook-mono tie bolt as inclined steel tension strut in a concrete web, FIG. 4: an embodiment with Z-clips and U-clips as the vertical reinforcement, FIG. 5: a perspective representation of the hollow body with a cupola-like vaulted cover surface, FIG. 6: a cross section of the hollow body with formed-on spacers, FIG. 7: a top view of the hollow body with spacers disposed in the form of a star, FIG. 8: a representation of the U-shaped distancing clip with the snap securement, FIG. 9: a section through a foot ring of the hollow body engaged with the snap securement, and FIG. 10: a longitudinal section through two stacked hollow bodies in a segment in the region of the annular offsets.

FIG. 1*a* depicts a portion of a hollow bodied ceiling 1 in vertical section and in 1*b* as top view, with the hollow bodies 2 enclosing within them an air space, the reinforced layer 3 above the hollow bodies and the reinforced layer 4 beneath the hollow bodies. Each of the reinforced layers is comprised of two directly superjacent layers of reinforcement bars. In the example drawn the hollow bodies 2 are so disposed that the axes of the concrete webs between the hollow bodies 2 form in ground plan a hexagonal honeycomb structure. There may be concrete webs 5 without steel struts 7 in the same ceiling, or concrete webs 5 with a steel strut 7 and concrete webs 5 with two steel struts 7 in the form of a diagonal cross 8. It is also possible that the vertical reinforcement rods 6, between which are located the steel struts 7 or diagonal crosses 8, are not disposed in the concrete web nodes but rather in the concrete webs between two concrete web nodes. It is furthermore possible that the vertical reinforcement rods 6 are omitted.

FIGS. 2*a* to 2*e* show different embodiments of the invention and each of the framework bearing systems, comprised of steel struts 6, 7, 8 and concrete compression struts 10, 11, developing under transverse force loading 9. Contrary to the simplified graphic illustration of FIGS. 2*a* to 2*e*, not all of the frameworks of the individual concrete webs are, in fact, in the same vertical plane, but rather in the vertical planes through the vertical reinforcement rods 6 or through the concrete web axes depicted in FIG. 1 in top view. Therewith the actual framework system, formed by the steel struts and concrete compression diagonals, is spatially not planar.

FIG. 2*a* shows a reinforcement system similar to the system disclosed in EP 1 252 403 A1, however with vertical reinforcements, for example comprised of hook-mono tie bolts, Z-clips or U-clips, instead of double tie bolts or of double tie bolts in the concrete webs between the concrete web nodes, each with or without fiber reinforcement in the concrete. The compression diagonal 10 is comprised of concrete or fiber concrete.

FIG. 2*b* shows the embodiment with double tie bolts acting as the steel struts 7 and only in the inclined compression struts of the developing inner framework bearing formwork. Advantageously, here a formwork with compression-stressed, approximately plumb rods of concrete 11 and two diagonals is formed in this concrete web, one under tensile stress of steel struts or double tie bolts 7 and one under compression stress of concrete 10.

The system in FIG. 2*c* is based on the system of FIG. 2*b*, however reinforced by the installation of additional vertical reinforcement rods 6, such as for example double tie bolts, hook-mono tie bolts 12, Z-clips 14 or U-clip 15, resulting in higher bearing strength.

In FIG. 2*d* the concrete compression diagonals 10 of the system of FIG. 2*a* are reinforced by double tie bolt 7, here under compression stress, in the axis of this compression diagonal.

Lastly, in FIG. 2*e* in all rods of the developing inner framework vertical steel struts 6 and inclined steel struts 8, such as for example double tie bolts, are disposed. Therewith the highest transverse force load-bearing strength of the ceiling is attained, in particular if the concrete is additionally reinforced with fibers. If, for the inclined steel struts 8, only double tie bolts are utilized, the embodiment according to FIG. 2*e* has, in addition, the advantage that—as is the case when only one double tie bolt is installed in each concrete web—there is no risk that during the installation the direction of the double tie bolt is confused.

FIG. 3*a* shows an embodiment of the invention with a hook-mono tie bolt as the vertical reinforcement 12 in one concrete web node or one concrete web and FIG. 3*b* an embodiment of the invention with hook-mono tie bolts as inclined steel tension strut 13 in one concrete web, in each instance instead of a double tie bolt. The hook-mono tie bolt is suspended via a rod of the reinforced layer over the hollow body and fixed on this rod by means of reinforcement lacing wire.

FIG. 4 shows an embodiment of the invention with Z-clips 14 or U-clips 15, instead of a double tie bolt, as vertical reinforcement rods 6 in a concrete web node or a concrete web 5 instead of a double tie bolt.

FIG. 5 shows the perspective view of the hollow body 2 according to the invention. Its periphery 17 is closed. The ground plan of the depicted hollow body 2 has a circular shape, wherein the hollow body being open at the bottom. The lower opening is bordered by a foot ring 22, which is formed onto the periphery 17.

The periphery 17 formed as a truncated cone continues upwardly into a horizontal annular offset 20, which subsequently transitions into the initially approximately vertical wall of a closed, approximately elliptical cupola-like vaulting 18. Upper spacers 19 are formed onto the cupola symmetrically to an imaginary vertical hollow body axis 28 and oriented radially outwardly. The upper crown lines 29 are straight and are located in an imaginary plane parallel to the foot ring 22. The invention also extends to bodies with the shape of the periphery of a truncated pyramid, for example with a hexagonal base surface.

The rib-shaped upper spacers 19 cover from the center radially outwardly approximately three-fourths of the diameter of the foot ring 22. They subsequently transition over into a bead 25, which is formed into the approximately elliptical cupola-like vaulting 18. This bead 25 terminates, in turn, at the annular offset 20. In this way the upper spacers in connection with the bead 25 reinforce the cupola-like vaulting 18. They are of such length that all rods of the lower layer of the upper reinforced layer 3 are sufficiently supported by the hollow body 2 and its neighbors.

In the upper vaulting, in addition, three venting holes 16 are provided symmetrically to the vertical hollow body axis 28.

FIG. 6 shows a cross section of the hollow body 2 with formed-on spacers 19 in the installed state. On the lower installed reinforced layer 4 is seated the foot ring 22. The upper radially disposed spacers 19, which are formed onto the approximately elliptical cupola surface 18, support on their horizontal apices the lower layer of the upper reinforced layer 3. The hollow body 2 is encompassed on all sides by concrete 30. The upper concrete edge of the concrete 30 penetrating from below into the hollow body 2 is denoted by the reference number 31. The pouring of the concrete 30 is facilitated through the gradient of the cupola-like vaulting 18 and of the radially disposed ribs 19, since it is more readily possible for the concrete to flow around the hollow body 2. In the embodiment depicted here, the radially disposed ribs 19 are separated from one another and do not centrally converge, as shown in FIG. 5 and FIG. 7.

FIG. 7 shows a top view onto a hollow body 2 according to the invention with spacers 19 arranged in the shape of a star. On the surface of the cupola-like vaulting 18 of hollow body 2 are disposed three venting holes 16 at angles of 120 degrees with respect to one another about the imaginary vertical hollow body axis 28. Between the venting holes 16 the radially disposed ribs 19 converge in the form of a star. The spacers 19 formed onto the cupola-like vaulting 18 can be produced in one production step together with the hollow body 2, for example, by injection molding. The lower opening of the hollow body 2 is bordered by a foot ring 22. Within this foot ring 22 six recesses 26 are disposed, which are offset by an angle of 60 degrees. A further embodiment provides hollow bodies 2 disposed in a rectangular pattern, whose four recesses are offset by 90 degrees. In the connection of the hollow bodies 2 to form a honeycomb-shaped structure, into these upwardly open recesses 26 extend U-shaped distancing clips 23 shown in FIG. 8 with their downwardly directed shanks 27. The snap securement 24 shown in FIGS. 8 and 9 extends therein form-fittingly behind the closed periphery 17.

FIG. 10 shows the manner in which a hollow body 2 according to the invention with stacking webs 32 is set onto a further hollow body 2 according to the invention, the stacking web 32 being seated on the annular offset 20 of the truncated cone-shaped periphery 17.

LIST OF REFERENCE NUMBERS

| | |
|---|---|
| 1 | Hollow bodied ceiling |
| 2 | Hollow body |
| 3 | Upper reinforced layer, comprised of two individual layers |
| 4 | Lower reinforcement layer, comprised of two individual layers |
| 5 | Concrete web between two hollow bodies |
| 6 | Vertical reinforcement rod |
| 7 | Steel strut |
| 8 | Diagonal cross |
| 9 | Transverse force loading |
| 10 | Compression diagonal of concrete |
| 11 | Approximately plumb compression strut of concrete |
| 12 | Hook-mono tie bolt as vertical reinforcement |
| 13 | Hook-mono tie bolt as tension-stressed steel strut |
| 14 | Z-clip as vertical reinforcement |
| 15 | U-clip as vertical reinforcement |
| 16 | Venting hole |
| 17 | Truncated cone- or truncated pyramid-shaped periphery |
| 18 | Cupola-like vaulting |
| 19 | Radially disposed ribs |
| 20 | Annular offset |
| 21 | Elliptical contour |
| 22 | Foot ring |

-continued

LIST OF REFERENCE NUMBERS

| | |
|---|---|
| 23 | Distancing clip |
| 24 | Snap securement |
| 25 | Bead |
| 26 | Recess |
| 27 | Shank |
| 28 | Vertical hollow body axis |
| 29 | Crown line |
| 30 | Concrete |
| 31 | Upper concrete edge in the hollow body |
| 32 | Stacking web |
| 33 | Ceiling wall |

The invention claimed is:

1. Steel-concrete hollow bodied slab or ceiling comprising: a plurality of concrete webs (5) disposed between a pattern of hollow bodies (2) with an upper reinforced layer (3) above the hollow bodies as well as with a lower reinforced layer (4) beneath the hollow bodies (2), each hollow body (2) being an uplift compression-free container downwardly open and circumferentially closed, in whose ceiling wall (33) includes venting holes (16), the container comprising spacers, and concrete of at least one concrete web (5) comprises at least one of fibers having tensile strength and at least one steel strut (6, 7), in the form of a double tie bolt, the uplift compression-free hollow body (2) having one of a truncated cone- or truncated pyramid-shaped periphery (17), whose upper termination forms a cupola-like vaulting (18), the uplift compression-free hollow body (2) includes at least three radially disposed ribs (19), offset by identical angles, which are formed onto the cupola-like vaulting (18) and the hollow body (2) comprises an annular offset (20) in the region between the truncated cone- or truncated pyramid-shaped periphery (17) and the cupola-like vaulting (18).

* * * * *